US008129895B2

(12) United States Patent
Kim et al.

(10) Patent No.: US 8,129,895 B2
(45) Date of Patent: Mar. 6, 2012

(54) FIELD EMISSION DEVICE WITH FINE LOCAL DIMMING

(75) Inventors: Dae Jun Kim, Daejeon (KR); Yoon Ho Song, Daejeon (KR); Jin Woo Jeong, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 0 days.

(21) Appl. No.: 12/741,253

(22) PCT Filed: Nov. 6, 2008

(86) PCT No.: PCT/KR2008/006521

§ 371 (c)(1),
(2), (4) Date: May 4, 2010

(87) PCT Pub. No.: WO2009/078578

PCT Pub. Date: Jun. 25, 2009

(65) Prior Publication Data

US 2010/0231119 A1 Sep. 16, 2010

(30) Foreign Application Priority Data

Dec. 17, 2007 (KR) ..... 10-2007-0132755

(51) Int. Cl.
*H05B 33/02* (2006.01)

(52) U.S. Cl. ..... 313/497

(58) Field of Classification Search ..... 313/309–311, 313/495–497

See application file for complete search history.

(56) References Cited

U.S. PATENT DOCUMENTS

| | | | | |
|---|---|---|---|---|
| 5,644,327 | A * | 7/1997 | Onyskevych et al. | 345/80 |
| 5,672,083 | A * | 9/1997 | Curtin et al. | 445/25 |
| 5,726,530 | A | 3/1998 | Peng | |
| 6,175,344 | B1 | 1/2001 | Tanaka | |
| 6,825,595 | B2 * | 11/2004 | Jin et al. | 313/311 |
| 6,897,855 | B1 * | 5/2005 | Matthies et al. | 345/204 |
| 2004/0251826 | A1 * | 12/2004 | Schlenker | 313/512 |
| 2006/0208627 | A1 * | 9/2006 | Kijima et al. | 313/496 |

FOREIGN PATENT DOCUMENTS

| | | | |
|---|---|---|---|
| EP | 0 364 964 | A2 | 4/1990 |
| JP | 2001-035352 | A | 2/2001 |
| KR | 1999-0024006 | A | 3/1999 |
| KR | 2002-0057639 | | 7/2002 |
| KR | 2006-0067010 | A | 6/2006 |
| KR | 2007-0050617 | | 5/2007 |
| KR | 2007-0077339 | A | 7/2007 |
| WO | WO 01/93302 | A1 | 12/2001 |

* cited by examiner

*Primary Examiner* — Toan Ton
*Assistant Examiner* — Hana Featherly
(74) *Attorney, Agent, or Firm* — Rabin & Berdo, PC

(57) ABSTRACT

Provided is a field emission device (FED) capable of fine local dimming. In the FED, a cathode substrate is comprised of a plurality of cathode layers, and a plurality of interconnections are disposed on each of the cathode layers, so that fine local dimming is enabled using a plurality of cathode blocks without limiting the number of the cathode blocks. Also, since RC delays of the respective cathode blocks can be synchronized according to the design of the interconnections, current control signals can be simultaneously transmitted to the respective cathode blocks, thereby improving the characteristics of the FED.

15 Claims, 3 Drawing Sheets

[Fig. 1]
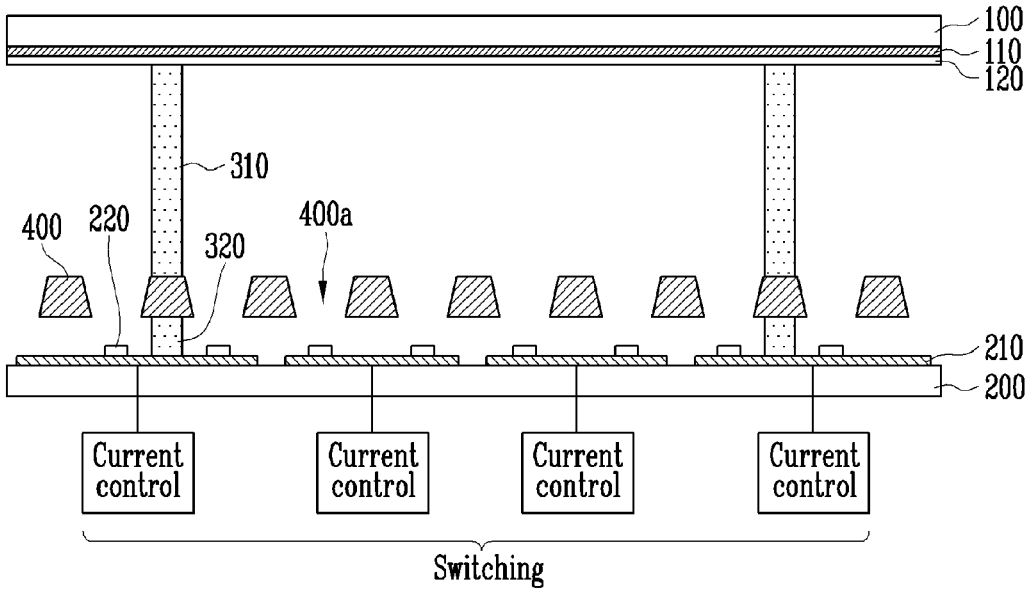
[Fig. 2]
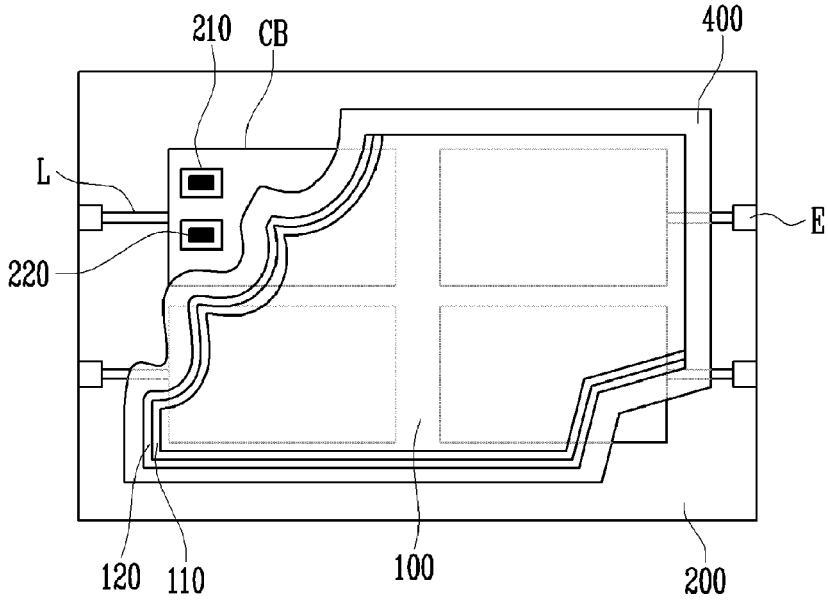

[Fig. 3]
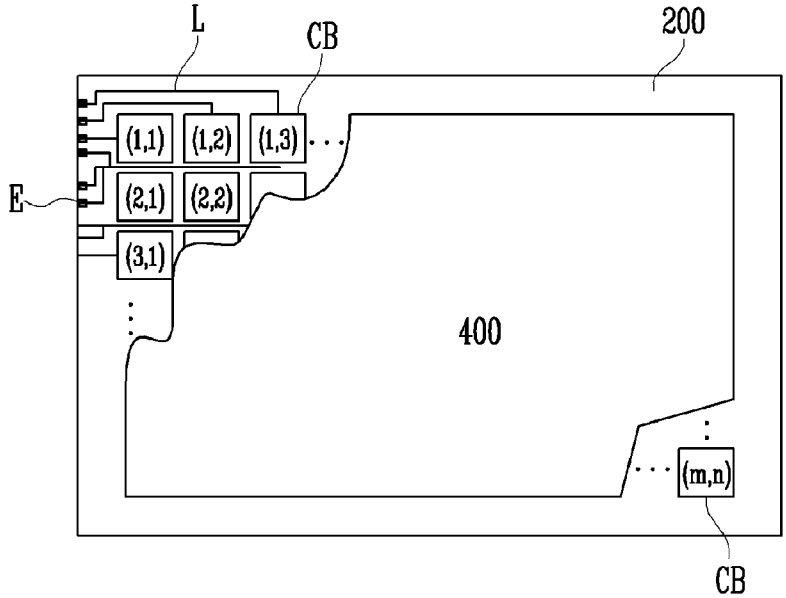
[Fig. 4]
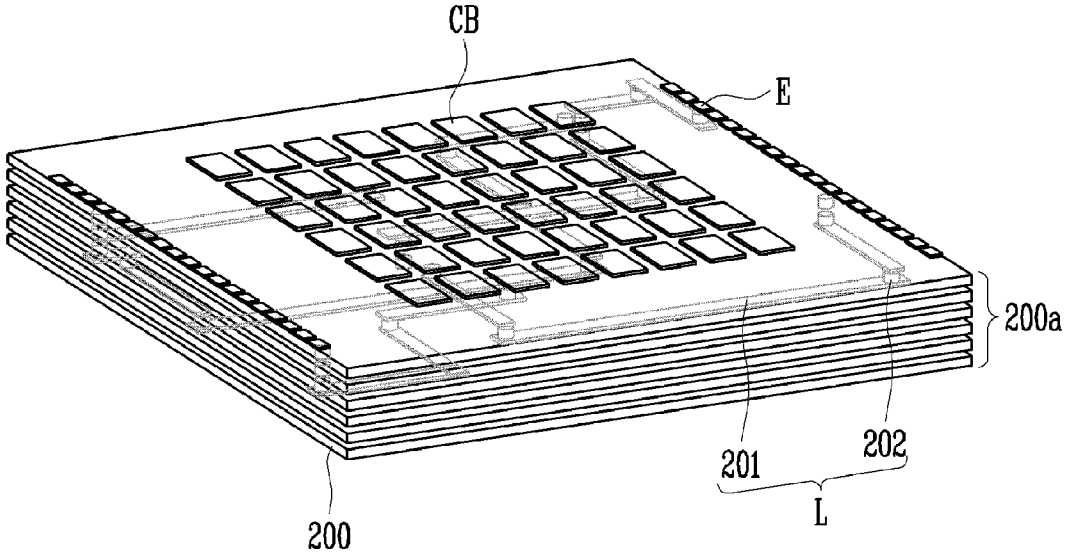

[Fig. 5]
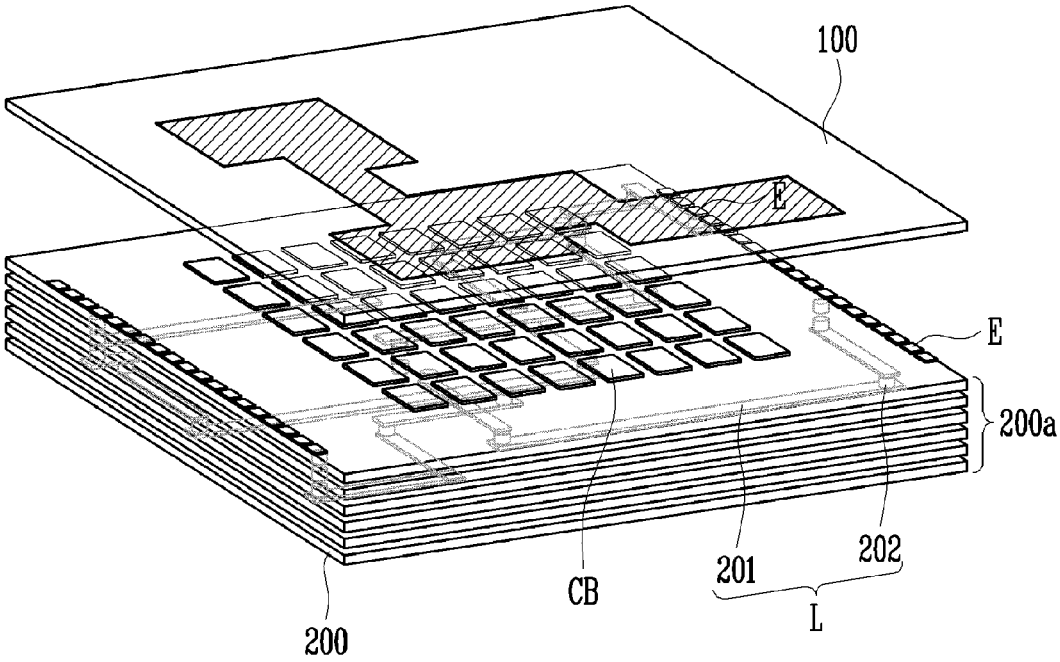

FIELD EMISSION DEVICE WITH FINE LOCAL DIMMING

TECHNICAL FIELD

The present invention relates to a field emission device (FED) capable of fine local dimming, and more particularly, to a FED capable of fine local dimming, in which a multilayered interconnection is formed on a cathode substrate to supply a current to a plurality of cathode blocks.

BACKGROUND ART

In general, flat panel displays (FPDs) may be classified into emissive displays and non-emissive displays.

The emissive displays may be cathode ray tubes (CRTs), plasma display panels (PDPs), and field emission displays (FEDs), and the non-emissive displays may be liquid crystal displays (LCDs).

Although an LCD is lightweight and consumes low power, the LCD is a non-emissive display that cannot be self-luminescent but receives external light to form an image so that an object cannot be observed using the LCD in a dark place. In order to solve this problem, a backlight unit (BLU) is installed on a rear surface of the LCD.

Conventional BLUs may employ cold cathode fluorescent lamps (CCFLs) functioning as linear light sources and light emitting diodes (LEDs) functioning as point light sources.

However, complicated constructions of BLUs have led to a rise in fabrication costs. Also, since a light source is disposed on a side of a BLU, power consumption increases due to reflection and transmission of light. Above all, it is difficult to ensure uniformity of luminance due to on-going scaling-up of LCDs.

In recent years, field emission BLUs having planar emissive structures have been developed in order to solve the above-described problems. Compared with conventional BLUs using CCFLs, the field emission BLUs consume low power and exhibit comparatively uniform luminance over large emission regions.

Conventionally, a field emission BLU includes a cathode substrate having a field emitter and an anode substrate having a fluorescent material, which are disposed a pre-determined distance apart from each other and opposite to each other and vacuum-packaged, so that electrons emitted from the field emitter collide with the fluorescent material of the anode substrate to cause cathode luminescence of the fluorescent material.

The above-described conventional FED will now be described in more detail with reference to FIG. 1.

FIG. 1 illustrates a conventional FED.

Referring to FIG. 1, an anode electrode 110 is disposed on one surface of an anode substrate 100, and a fluorescent material 120 is disposed on one surface of the anode electrode 110. A cathode electrode 210 is disposed on one surface of a cathode substrate 200, and field emitters 220 are disposed on a first substrate of the cathode electrode 210. A gate electrode 400 is disposed over the cathode substrate 200 on which the cathode electrode 210 and the field emitters 220 are disposed. Each of the field emitters 220 is exposed through an inclined opening 400*a* of the gate electrode 400 opposite to the fluorescent material 120. Also, a plurality of first spacers 310 are disposed between the gate electrode 400 and the anode electrode 110, and a plurality of second spacers 320 are disposed between the gate electrode 400 and the cathode electrode 210.

When a predetermined drive voltage is applied to the cathode electrode 210, the gate electrode 400, and the anode electrode 110, electron beams are radially emitted from the field emitter 220. As a result, the electron beams emitted from the field emitter 220 reach a portion of the fluorescent material 120 corresponding to the corresponding pixel to emit light.

On the other hand, a CCFL having the above-described construction operates at low speed, thus precluding partial dimming or pulse driving. Furthermore, there is a specific limit for increasing a contrast ratio or eliminating a residual image from a dynamic picture.

In order to overcome the above-described drawbacks, a BLU using an LED controls luminance or drives pulses according to an image displayed on a picture so as to obtain a high contrast ratio and a clear moving image. However, the BLU using the LED requires a high fabrication cost and complicated driver circuits. In addition, the BLU using the LED has a relatively short lifetime and hinders surface emission.

Therefore, a vast amount of research has been conducted on field emission lamps capable of local dimming in which a plurality of cathode electrodes are embodied as cathode blocks. However, when the number of the cathode blocks is increased to enable fine local dimming, interconnections between the cathode blocks and external electrodes become complicated.

Owing to the above-described problems, a field emission lamp capable of standard local dimming has only a limited number of cathode blocks, thereby hindering fine local dimming.

DISCLOSURE OF INVENTION

Technical Problem

The present invention is directed to a field emission device (FED) capable of fine local dimming, in which a multilayered cathode substrate is prepared and a multilayered interconnection is disposed on each cathode substrate so that fine local dimming is enabled using a plurality of cathode blocks without limiting the number of the cathode blocks.

Technical Solution

One aspect of the present invention provides a field emission device (FED) capable of fine local dimming. The FED includes: an anode substrate including an anode electrode and a fluorescent material disposed on one surface of the anode substrate; a cathode substrate disposed opposite to the anode substrate and including a plurality of cathode electrodes and a field emitter disposed on one surface of the cathode substrate; and a gate electrode interposed between the anode substrate and the cathode substrate, wherein the cathode electrodes are blocked to configure in a plurality of cathode blocks according to sub-pixels or specific regions, and the cathode substrate is formed in a multi-layered structure so that a plurality of interconnections for connecting the respective cathode blocks with external electrodes are stacked in a multi-layered structure on the cathode substrate of each layer.

When a current control signal is applied to the cathode block corresponding to a specific region to enable fine local dimming of the specific region, only a specific region of the anode substrate may emit light by controlling electron beams of the cathode block.

Also, the amount of the electron beams emitted from the field emitter may be controlled using a plurality of cathode electrodes included in the cathode block so that only the specific region of the anode substrate emits light.

The interconnections may be stacked and arranged on the cathode substrate of each layer through internal electrodes and via holes. The linewidths of the interconnections and the diameters of the via holes may be controlled so that current control signals are simultaneously transmitted to the respective cathode blocks.

The cathode substrate including a plurality of cathode layers may be provided and a plurality of interconnections may be stacked on the respective cathode layers using one selected from the group consisting of a low-temperature co-fired ceramic (LTCC) technique, a high-temperature co-fired ceramic (HTCC) technique, and a multilayer screen printing technique.

Advantageous Effects

According to the present invention, a cathode substrate includes a plurality of cathode layers, and a plurality of interconnections are disposed on each of the cathode layers so that a FED capable of fine local dimming can be embodied using a plurality of cathode blocks without limiting the number of the cathode blocks. As a result, since a technical limit for local dimming of the FED can be overcome, the FED can obtain a high contrast ratio and enable reproduction of clear moving images.

Furthermore, since RC delays of the respective cathode blocks can be synchronized according to the design of the interconnections, current control signals can be simultaneously transmitted to the respective cathode blocks, thereby improving the characteristics of the FED.

BRIEF DESCRIPTION OF THE DRAWINGS

FIG. 1 illustrates a conventional field emission device (FED).

FIG. 2 is a schematic diagram of a FED capable of local dimming.

FIG. 3 is a schematic diagram of a FED in which m×n cathode blocks are formed to enable fine local dimming.

FIG. 4 is a diagram for explaining the characteristics of a FED according to an exemplary embodiment of the present invention.

FIG. 5 is a diagram for explaining fine local dimming operation of a FED according to an exemplary embodiment of the present invention.

DESCRIPTION OF MAJOR SYMBOL IN THE ABOVE FIGURES

100: Anode substrate
110: Anode electrode
120: Fluorescent material
200: Cathode substrate
210: Cathode electrode
220: field emitter
310, 320: Spacer
400: Gate
L: Interconnection
E: External electrode

MODE FOR THE INVENTION

A field emission device (FED) capable of fine local dimming according to the present invention will be described more fully hereinafter with reference to the accompanying drawings, in which exemplary embodiments of the invention are shown.

To facilitate understanding, a typical FED capable of local dimming will be briefly described.

FIG. 2 is a schematic diagram of a FED capable of local dimming, and FIG. 3 is a schematic diagram of a FED in which m×n cathode blocks are formed to enable fine local dimming.

Referring to FIG. 2, in the case of the FED capable of local dimming, a plurality of cathode electrodes 210 are blocked and included in cathode blocks CB according to sub-pixels or specific regions.

That is, when a voltage applied to the gate electrode 400 or the anode electrode 110 is fixed, amounts of electron beams emitted from a field emitter 220 through the cathode electrode 210 included in each of the cathode blocks CB are controlled by adjusting the amount of current supplied to the corresponding cathode block CB, so that local dimming is enabled.

The amount of current supplied to each of the cathode blocks CB may be controlled using a semiconductor switching circuit (not shown), such as a thin film transistor (TFT) or a metal-oxide-semiconductor field effect transistor (MOSFET). Also, the amount of current supplied to the cathode block CB may be controlled using a pulse width modulation (PWM) method or a pulse amplitude modulation (PAM) method.

Meanwhile, a liquid crystal display (LCD) requires finer local dimming in order to obtain UD (Ultra Definition) output and a high contrast ratio and solve a residual image during reproduction of moving images. Accordingly, the greatest possible number of cathode blocks CB must be ensured as shown in FIG. 3.

As shown in FIG. 2, when only four cathode blocks CB are provided, a simple interconnection L for connecting an external electrode E and each of the cathode blocks CB is formed on a single plane. However, when the number of cathode blocks CB is increased in order to enable fine local dimming as shown in FIG. 3, an increased number of interconnections L, that is, m×n interconnections L, are needed. As a result, connecting the interconnections L on a single plane becomes very complicated.

Furthermore, the cathode blocks CB must be disposed as adjacently as possible in order to prevent arcing caused by unnecessary charging/discharging of electrons emitted from the field emitter 220. However, since the cathode substrate 200 is embodied as a single substrate, the interconnections L must be formed to have very fine linewidths so that m×n cathode blocks CB can be connected to m×n external electrodes E.

However, when the interconnections L are formed to have the very fine linewidths, the interconnections L not only have high resistances, but also high resistance differences there between, so that a current control signal for controlling each of the cathode blocks CB may not reach a desired point in time due to a resistance-capacitance (RC) delay difference.

Owing to the foregoing problems, a typical FED capable of local dimming has limited number of cathode blocks CB, thereby precluding fine local dimming.

In order to overcome the above-described problems, according to the present invention, a multilayered cathode substrate is provided and a plurality of interconnections are stacked on each cathode substrate so that fine local dimming is enabled using a plurality of cathode blocks without limiting the number of the cathode blocks as will now be described in more detail.

FIG. 4 is a diagram for explaining the characteristics of a FED according to an exemplary embodiment of the present invention.

Referring to FIG. 4, in the FED, a cathode substrate 200*a* includes a plurality of cathode substrates 200. An interconnection L for connecting each of cathode blocks CB with an external electrode E is stacked on each of the cathode substrates 200.

The interconnections L are stacked and arranged on the respective cathode substrates 200 through internal electrodes 201 and via holes 202.

As described above, when the interconnection L for connecting the cathode block CB and the external electrode E is stacked on each of the cathode substrates 200, arrangement of the interconnections L has a greatly increased degree of freedom.

In other words, even if a plurality of cathode blocks CB are provided, a plurality of interconnections L for connecting the respective cathode blocks CB and the external electrodes E can be stacked on the respective cathode substrates 200. Therefore, any number of cathode blocks CB can be embodied according to the number of the cathode substrates 200, thus enabling fine local dimming.

In addition, a FED according to the present invention can synchronize RC delays of the respective cathode blocks CB by controlling the linewidths of the interconnections L and the diameters of the via holes 202. Thus, current control signals may be simultaneously transmitted to the respective cathode blocks CB.

Meanwhile, the multilayered cathode substrate 200*a* and the multilayered interconnection L may be provided using the following methods.

First, a technique of forming a multilayered structure, such as a low-temperature co-fired ceramic (LTCC) technique or a high-temperature co-fired ceramic (HTCC) technique, may be employed.

Specifically, the internal electrode 201 and the via hole 202 are formed in each of bulk ceramic layers, which are called "Green sheets," using punching and screen printing processes, and the bulk ceramic layers are laminated and fired.

In general, an LTCC technique is performed using an Ag electrode and an Ag/Pd electrode, an HTCC technique is performed using a W electrode, and a ceramic substrate is used for both the LTCC and HTCC techniques. Also, the LTCC technique may be performed at a temperature of about 900° C., and the HTCC technique may be performed at a temperature of about 1600° C. The ceramic substrate may have a thickness of about minimum 10 μm or more.

In the LTCC or HTCC technique, each ceramic substrate may be used as an external substrate for vacuum sealing or bonded to a glass substrate appropriate for vacuum sealing.

Second, a multilayer screen printing technique used for fabrication of typical plasma display panels (PDPs) may be adopted.

Specifically, the internal electrode 201 and the via hole 202 are printed on each insulating layer, dried, and printed again so that an interconnection is stacked on each cathode substrate.

FIG. 5 is a diagram for explaining fine local dimming operation of a FED according to an exemplary embodiment of the present invention.

Referring to FIG. 5, in the FED according to the present invention, only a specific region of an anode substrate 100 may emit light by controlling electron beams of each of cathode blocks CB.

Accordingly, when an HD or UD LCD is embodied using a FED according to the present invention, very fine local dimming is enabled and can even come up to the level of the resolution of an LCD. Furthermore, the FED according to the present invention can obtain a high contrast ratio and eliminate a residual image during reproduction of moving images.

While the invention has been shown and described with reference to certain exemplary embodiments thereof, it will be understood by those skilled in the art that various changes in form and details may be made therein without departing from the spirit and scope of the invention as defined by the appended claims.

The invention claimed is:

1. A field emission device (FED) capable of fine local dimming, comprising:

an anode substrate including an anode electrode;

a fluorescent material disposed on one surface of the anode substrate;

a multi-layered cathode substrate disposed opposite to the anode substrate and including a plurality of cathode electrodes, the cathode substrate being formed in a multi-layered structure comprised of a plurality of cathode substrate layers;

a field emitter disposed on one surface of the cathode substrate;

a plurality of cathodes blocks touching a side of a first cathode substrate layer, each cathode block including a plurality of the cathode electrodes, each cathode block corresponding to sub-pixels or specific regions;

a plurality of external electrodes touching said side;

a plurality of interconnections for connecting the cathode blocks with the plurality of external electrodes, the plurality of interconnections each being stacked in the multi-layered structure on respective cathode substrate layers, the plurality of interconnections touching a plurality of cathode substrate layers; and a gate electrode interposed between the anode substrate and the cathode substrate.

2. The FED according to claim 1, wherein, each cathode block is configured such that when a current control signal is applied to the cathode block that corresponds to a specific region to enable fine local dimming of the specific region, the cathode block allows only a specific region of the anode substrate to emit light by controlling the emission of electron beams towards the specific region of the anode.

3. The FED according to claim 2, including a plurality of field emitters disposed on the cathode blocks, wherein each cathode block is configured such that an amount of the electron beams emitted from a respective field emitter is controlled using the plurality of cathode electrodes included in the cathode block so that only the specific region of the anode substrate emits light.

4. The FED according to claim 1, wherein the interconnections are stacked and arranged on the cathode substrate layers through internal electrodes and via holes.

5. The FED according to claim 4, wherein linewidths of the interconnections and diameters of the via holes are controlled so that current control signals are simultaneously transmitted to the respective cathode blocks.

6. The FED according to claim 1, wherein a plurality of interconnections are stacked on respective cathode substrate layers using one selected from the group consisting of a low-temperature co-fired ceramic (LTCC) technique, a high-temperature co-fired ceramic (HTCC) technique, and a multilayer screen printing technique.

7. The FED according to claim 6, wherein each ceramic layer used for the LTCC technique or the HTCC technique is used as an external substrate for vacuum sealing or bonded to a glass substrate appropriate for vacuum sealing.

8. The FED according to claim 1, wherein a first spacer is interposed between the anode electrode and the gate electrode, and a second spacer is interposed between the gate electrode and the cathode electrode.

9. The FED according to claim 1, wherein the field emitter is formed of one selected from the group consisting of a carbon nanotube (CNT), carbon nanofiber (CNF), and a carbon compound.

10. The FED according to claim 1, wherein a first plurality of cathode substrate layers each touch one or more of the interconnections and are positioned so that the first cathode substrate layer is between the first plurality of cathode substrate layers, and the anode substrate.

11. The FED according to claim 1, wherein a first plurality of interconnections for connecting one or more of the respective cathode blocks with one or more of the plurality of external electrodes contacts a second cathode substrate layer, and a second plurality of interconnections for connecting one or more of the respective cathode blocks with one or more of the plurality of external electrodes contacts a third cathode substrate layer, the third cathode substrate layer being below the second cathode substrate layer.

12. The FED according to claim 11, wherein the first plurality of interconnections passes over the second plurality of interconnections.

13. The FED according to claim 11, wherein the first plurality of interconnections passes directly over the second plurality of interconnections.

14. The FED according to claim 1, wherein the plurality of external electrodes touch the first cathode substrate layer at an edge of the first cathode substrate layer and a second edge of the first cathode substrate layer opposite the first edge, and the Plurality of cathode blocks touch a central portion of the first cathode substrate layer that is between the first edge and second edge.

15. The FED according to claim 1, wherein the plurality of external electrodes touch the first cathode substrate layer at an edge of the first cathode substrate layer, and the plurality of cathode blocks touch a central portion of the first cathode substrate layer.

* * * * *